US008820067B2

(12) United States Patent
Gauthier

(10) Patent No.: US 8,820,067 B2
(45) Date of Patent: Sep. 2, 2014

(54) VARIABLE DISPLACEMENT HYDRAULIC MACHINE, IN PARTICULAR FOR A MOTOR VEHICLE

(75) Inventor: Pierre Gauthier, Chaville (FR)

(73) Assignee: Technoboost, Paris (FR)

( * ) Notice: Subject to any disclaimer, the term of this patent is extended or adjusted under 35 U.S.C. 154(b) by 0 days.

(21) Appl. No.: 13/989,681

(22) PCT Filed: Nov. 16, 2011

(86) PCT No.: PCT/FR2011/052653

§ 371 (c)(1),
(2), (4) Date: Jul. 5, 2013

(87) PCT Pub. No.: WO2012/069734

PCT Pub. Date: May 31, 2012

(65) Prior Publication Data

US 2013/0284011 A1 Oct. 31, 2013

(30) Foreign Application Priority Data

Nov. 25, 2010 (FR) ..... 10 59752

(51) Int. Cl.

| | |
|---|---|
| ***F04B 1/32*** | (2006.01) |
| ***F03C 1/40*** | (2006.01) |
| ***F03C 1/06*** | (2006.01) |
| ***F01B 13/00*** | (2006.01) |
| ***F04B 1/22*** | (2006.01) |

(52) U.S. Cl.

CPC ..... *F01B 13/00* (2013.01); *F03C 1/0686* (2013.01); *F03C 1/0639* (2013.01); *F04B 1/324* (2013.01); *F04B 1/22* (2013.01)

USPC ..... 60/487

(58) Field of Classification Search

USPC ..... 60/487

See application file for complete search history.

(56) References Cited

U.S. PATENT DOCUMENTS 2,678,536 A * 5/1954 Morgan ..... 60/488
3,093,081 A 6/1963 Budzich (Continued)

FOREIGN PATENT DOCUMENTS

DE 3127610 A1 1/1983
EP 1519042 A1 3/2005

(Continued)

OTHER PUBLICATIONS

International Search Report from corresponding International Application No. PCT/FR2011/052653 mailed Jan. 30, 2012.

(Continued)

*Primary Examiner* — Thomas E Lazo

(74) *Attorney, Agent, or Firm* — Polster, Lieder, Woodruff & Lucchesi, L.C.

(57) ABSTRACT

The invention relates to a variable displacement hydraulic machine, in particular for a motor vehicle, said hydraulic machine comprising a rotating cylinder (10) including a series of axial pistons (12) connected to a first plate (14) axially located on one side of said cylinder within a substantially transverse plane, the slope of which can be controlled, so as to form a first controllable displacement for said machine, wherein said machine is characterized in that the cylinder (10) further comprises a second series of axial pistons (22) connected to a second plate (24), the slope of which is also controllable, said plate being axially located, relative to the first plate (14), on the other side of said cylinder so as to form a second controllable displacement for said machine.

8 Claims, 2 Drawing Sheets

(56) References Cited

U.S. PATENT DOCUMENTS

| | | | | | |
|---|---|---|---|---|---|
| 3,161,023 | A | * | 12/1964 | Margolin et al. | 60/488 |
| 3,643,434 | A | | 2/1972 | Widmaier | |
| 4,967,556 | A | * | 11/1990 | Inoue | 60/487 |
| 6,109,033 | A | * | 8/2000 | Folsom et al. | 60/487 |
| 2005/0120873 | A1 | | 6/2005 | Gray | |

FOREIGN PATENT DOCUMENTS

| | | | |
|---|---|---|---|
| GB | 553483 | A | 5/1943 |
| GB | 663648 | A | 12/1951 |
| GB | 709183 | A | 5/1954 |
| WO | 03012289 | A1 | 2/2003 |
| WO | 03/058035 | A1 | 7/2003 |

OTHER PUBLICATIONS

Written Opinion from corresponding International App. No. PCT/FR2011/052653, mailed May 28, 2013.

* cited by examiner

VARIABLE DISPLACEMENT HYDRAULIC MACHINE, IN PARTICULAR FOR A MOTOR VEHICLE

CROSS-REFERENCE TO RELATED APPLICATIONS

The present application is the US national stage under 35 U.S.C. §371 of International Application No. PCT/FR2011/052653 having an international filing date of Nov. 16, 2011, which claims the priority of French application 1059752 filed on Nov. 25, 2010.

BACKGROUND

This invention relates to a variable displacement hydraulic machine capable of working as an engine or as a pump, in particular for a hybrid vehicle, as well as a power train and a hybrid vehicle equipped with such hydraulic machine.

Hybrid vehicles comprise in general a combustion engine which provides the main motorization of the vehicle and an additional motorization using energy that can be stored, such as electric or hydraulic energy, to optimize the combustion engine operation.

Hybrid vehicles using hydraulic energy, comprise a hydraulic machine connected to drive wheels of the vehicle, capable of operating as a pump to charge the hydraulic pressure accumulators which store energy, or as an engine to deliver mechanical power to the drive wheels while drawing energy stored in the accumulators.

In particular, during braking, one can use the hydraulic machine as a pump to recover and store the kinetic energy of the vehicle; this energy is subsequently returned by the hydraulic machine operating as an engine for driving the vehicle. This use of stored hydraulic power enables optimizing the combustion engine operation, and to reduce its fuel consumption and the polluting gas emissions. The hydraulic energy storage also permits driving in hydraulic mode or zero emission mode "ZEV" during which the vehicle does not emit polluting gases, with the combustion engine being shut down.

A type of known variable displacement hydraulic machine comprises a rotating cylinder comprising axial pistons distributed as a crown around the axis, which are connected to a plate which is located in a substantially transverse plane. By controlling or adjusting the slope of the plate with respect to the transverse plane, one modifies the stroke of the pistons that can go from a zero stroke with the plate in the transverse plane, resulting in a zero displacement, to a maximum stroke with the strongest plate slope, resulting in the maximum displacement.

A known hydraulic machine made according to a variant, shown for example in document WO-A1-2003/058035, comprises a cylinder with a series of axial bores in which floating or free piston rods slide. Axially on each side of the cylinder, there is a tiltable plate that supports bores in which the ends of the piston rods slide, each forming a piston.

This way, one obtains a compact hydraulic machine, comprising a single displacement that can be considerable by doubling sets of pistons on each side of the cylinder.

However, this type of hydraulic machine comprises a performance that varies greatly on the basis of the displacement actually used, of the speed and the pressure of operation. In that case, one is obligated for an operation on a vehicle that requires varied ranges of use in torque and power, to have at least two hydraulic machines comprising two different displacements, in order to use each of these machines for its optimal operating range.

Installing two hydraulic machines creates problems, in particular related to weight, overall dimensions and installation in the vehicle. In addition, this type of machine can produce noise during operation, as well as torque pulsations tied to the number of pistons.

SUMMARY

In particular, the purpose of this invention is to avoid these inconveniences of the prior art and to propose a compact hydraulic machine with good performance under varied operating conditions, which is suitable in particular for a hybrid vehicle.

For that purpose, a variable displacement hydraulic machine, in particular for a motor vehicle, is disclosed, the machine comprising a rotating cylinder comprising a series of axial pistons connected to a first plate situated axially on one side of this cylinder, in a substantially transverse plane for which the slope is controllable or adjustable, to form a first controllable or adjustable displacement of this machine, characterized in that the cylinder also comprises a second series of axial pistons connected to a second plate for which the slope is also controllable or adjustable, which is situated axially with respect to the first plate on the other side of this cylinder, to form a second controllable or adjustable displacement of this machine.

An advantage of this hydraulic machine is that one can situate the various bores receiving the two compact piston series on the same cylinder, to form two different pumps for which the different displacements are controlled independently by the adjustment of each of the two tiltable plates.

The hydraulic machine can also comprise one or several of the following features, which can be combined between each other.

Beneficially, the two plates each comprise an independent adjustment of their slope.

Beneficially, the two series of pistons of each displacement, each form a crown centered on the axis and comprising a different radius.

According to an embodiment, the hydraulic machine comprises, for each displacement, a hydraulic circuit that comprises a low pressure chamber and a high pressure chamber, separated by two angular sections that are situated at two diametrically opposite points in contact with the outside cylinder contour or wall of the cylinder; it ensures a dynamic seal between these chambers. Each bore of the pistons comprises a communication conduit arranged radially towards the outside to communicate with these chambers.

Beneficially, the two displacements of this machine each comprise the same number of pistons, with the pistons of the inside crown being angularly offset with respect to the pistons of the outside crown and the communication conduits of the pistons of the inside crown are inserted angularly between the pistons of the outside crown.

The low and high pressure chambers as well as the communication conduits of each hydraulic circuit can be situated on transverse planes axially offset with respect to each other.

Optionally, each angular seal section can comprise in its central part, a central channel connected to the outside hydraulic circuit; the width of the communication conduits is provided so that these conduits run out in a certain angular position of the cylinder, at the same time in one of the two pressure chambers, and in this central channel.

A transition solenoid valve can be situated between the central channel and the outside hydraulic circuit.

A drive train for a hybrid vehicle is proposed comprising a hydraulic traction machine which includes any of the preceding features.

In addition, a hybrid vehicle is proposed comprising a drive train with a combustion engine and a hydraulic traction machine, which includes any of the preceding features.

DESCRIPTION OF THE FIGURES

The invention will be better understood and other features and benefits will appear more clearly upon reading the following description given as an example and without limitation, referenced against the attached drawings where.

DETAILED DESCRIPTION

Figure 1:
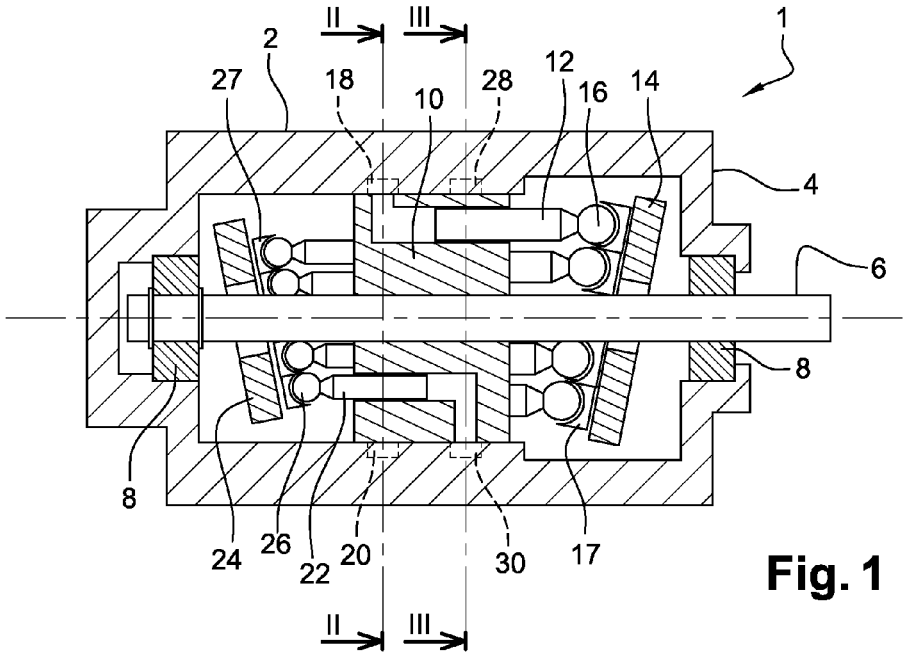
FIG. 1 is an axial sectional view of a hydraulic machine.
Figure 2:
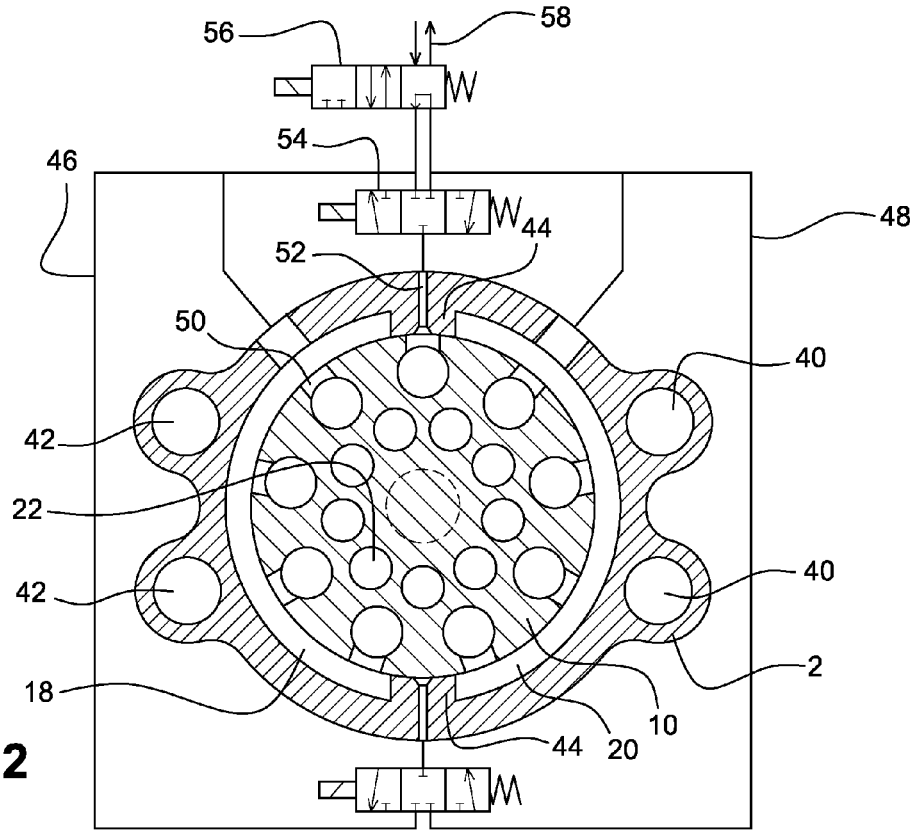
FIG. 2 is a transverse sectional view of this hydraulic machine, taken along the sectional plane II of FIG. 1.
Figure 3:
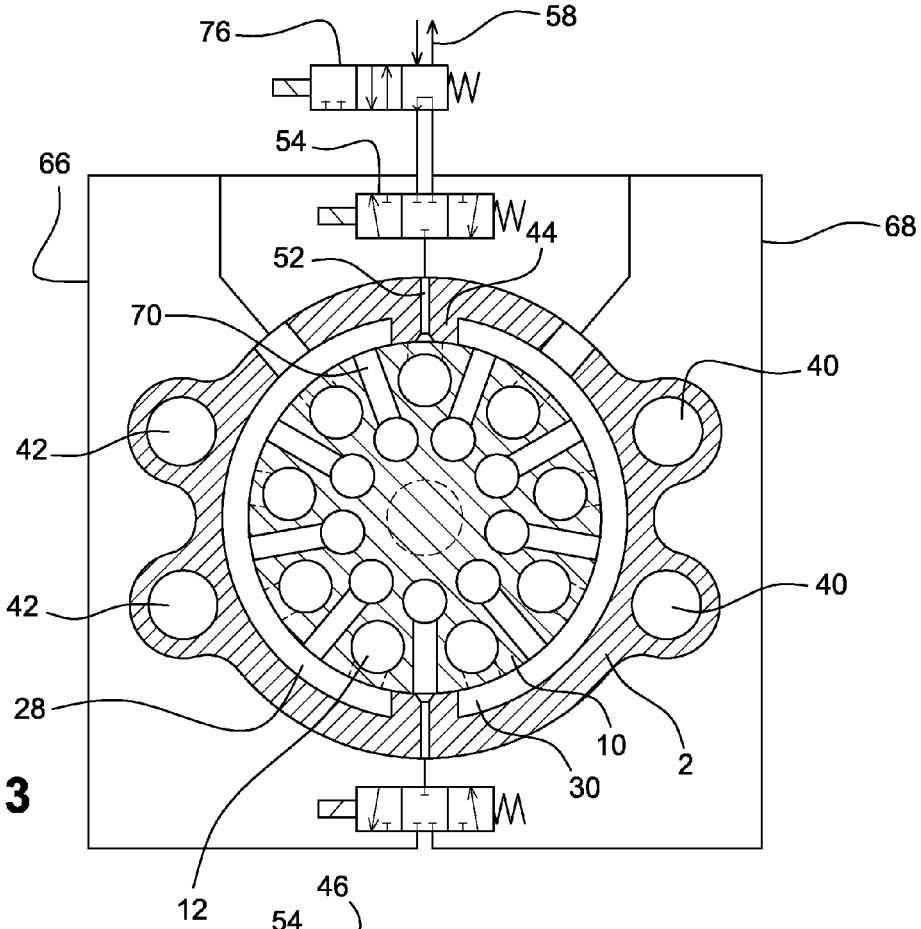
FIG. 3 is a transverse sectional view of this hydraulic machine, taken along the sectional plane III of FIG. 1.

FIGS. 1 to 3 show a hydraulic machine 1 comprising a casing or housing 2, which is overall cylindrical in form and centered on an axis. The housing defines a cylindrical inner cavity that is axially closed in a sealed manner on one side by a cover 4.

The inner cavity is traversed by an axially situated shaft 6 which is guided during rotation by two bearings 8, one kept in the housing 2 and the other in the cover 4. One end of shaft 6 coming out of the hydraulic machine 1 on the cover 4 side, is connected by a transmission (not shown) to the drive wheels of a hybrid vehicle, in the event that this hydraulic machine is provided for this type of vehicle.

A rotating cylinder 10 secured to shaft 6 is fitted in the cylindrical cavity of housing 2. Cylinder 10 comprises a first series of nine axially situated bores, and distributed regularly to form a crown comprising a large radius, situated near the outside contour or surface of the cylinder 10.

As a variant, one can use a different number of bores, preferably an odd number, such as seven or eleven for instance, which modifies the cyclic regularity or the complexity of hydraulic machine 1.

Each bore of this first series of bores receives a piston 12 of which the exiting end on the right side of cylinder 10, is connected by a ball joint 16 to a friction shoe 17 which is supported on a first plate 14 located in a substantially transverse plane. A slope control or adjustment mechanism comprising an actuator 40 integrated in housing 2, permits the adjustment of a small slope for this first plate 14 around the transverse plane.

In addition, cylinder 10 includes a second series of bores with a same number of bores, nine in this example, arranged axially and distributed in a regular fashion to form a crown of a small radius which is situated radially inside the first series of bores.

Each bore of the second series of bores receives a piston 22 for which the exiting end on the opposite or left side of cylinder 10 is connected by a ball joint 26 to a friction shoe 27 which is supported on a second plate 24 situated in a substantially transverse plane. A slope control or adjustment mechanism comprising an actuator 42 integrated in housing 2, permits to control or adjust the small slope of this second plate 24 around the transverse plane, independently from the adjustment of first plate 14.

Each plate 14, 24 is rotationally fixed with respect to the axis of housing 2, with a slope that is controllable or adjustable with respect to the transverse plane; pistons 12, 22 remain in contact with these plates, by sliding on top by means of friction shoes 17, 27.

As such, a rotation of cylinder 10 and of pistons 12, 22 is obtained which involves at the same time a sliding of each series of pistons according to a back and forth cycle by complete rotation of shaft 6, according to a stroke adjusted or controlled for each series by the slope of its plate 14, 24.

Pistons 12 of the first series of pistons have a larger diameter than the pistons of the second series, thus providing hydraulic machine 1 with a large displacement defined by the diameter and maximum stroke of the first series of pistons, while pistons 22 of the second series have a smaller diameter, thus providing a small displacement also defined by their diameter and their maximum stroke.

One will observe that the two displacements, large and small, are each adjustable or controllable independently between a zero volume and a maximum volume.

The hydraulic circuit of the large displacement (i.e., of the first series of pistons 12) is detailed in FIG. 2.

In a transverse plane aligned at the bottom of the first series of bores of the large displacement, the inside cavity of housing 2 comprises a low pressure chamber 18 and a high pressure chamber 20, separated by two angular sections 44 with small width formed by housing 2 which are located at two diametrically opposite points in permanent contact with the outside cylindrical contour or wall of cylinder 10. The two angular sections 44 form a dynamic seal that isolates the low pressure chamber 18 and high pressure chamber 20 of the large displacement from each other during the rotation of cylinder 10.

Each bore of the first series comprises in the transverse plane pressure chambers 18, 20, a communication conduit 50 turned radially towards the outside, positioning alternatively in communication, the chamber of the first pistons 12 with the low pressure chamber 18 or the high pressure chamber 20, according to the angular position of this cylinder.

The angular position of the two sealing sections 44 is defined to separate both chambers 18, 20 in the positions of top or bottom dead center of pistons 12, so that for each chamber the pistons move in the same direction, while increasing or decreasing the volumes of these chambers.

Each low pressure chamber 18 or high pressure chamber 20 is connected by a respectively low pressure 46 or high pressure 48 external channel (FIG. 4), to a supply/feed solenoid valve 56.

The supply/feed solenoid valve 56 includes three positions providing alternatively a direct connection of the two external channels 46, 48 between each other, permitting a no-load rotation of the hydraulic machine with very little resistance, with the fluid passing directly from the high pressure chamber 20 to the low pressure chamber 18, a connection with two outside channels 58 connecting hydraulic machine 1 to pressure accumulators, to receive or send energy towards these accumulators according to whether this machine operates respectively as an engine or as a pump, or a closing of the two external channels 46, 48 which blocks the hydraulic machine.

By always keeping the same chambers 18, 20 for low and high pressure, hydraulic machine 1 turns in one or the other of the two directions of rotation, so as to operate as an engine or as a pump.

As a variant, one can invert the links with the hydraulic accumulators to exchange between the low pressure 18 and high pressure 20 chambers, to operate as an engine or as a pump while keeping the same direction of rotation of hydraulic machine 1.

The hydraulic circuit for the small displacement (i.e., of the second series of pistons 22) is shown in detail in FIG. 3.

This hydraulic circuit is similar to the hydraulic circuit for the large displacement. It comprises in the same fashion, with an axial offset to find itself in the transverse plane aligned at the bottom of the second series of bores of the small displacement, a low pressure chamber 28 and a high pressure chamber 30 separated by two angular sections 44, and in cylinder 10, communication conduits 70 turned radially towards the outside for each bore of this small displacement.

The two displacements (i.e., the large and small displacements) each comprise the same number of pistons, pistons 22 of the internal crown being angularly offset with respect to pistons 12 of the external crown; their communication conduits 70 inserted angularly between each piston 12 of the external crown.

The hydraulic circuit of the small displacement also comprises two external channels, for low pressure 66 and for high pressure 68 and a supply/feed solenoid valve 76 connected to the outside conduits 58.

Operation of this second small displacement circuit is similar to the one of the first large displacement circuit, with an independent control or adjustment of its plate 24, with its reduced displacement delivering lower levels of torque and power, which permit obtaining a better performance in the event that small torque values or small performance values are required, whether as an engine or as a pump.

One can also obtain maximum power of hydraulic machine 1 for an operation as an engine or as a pump, by working simultaneously with the two displacements.

Figure 4:
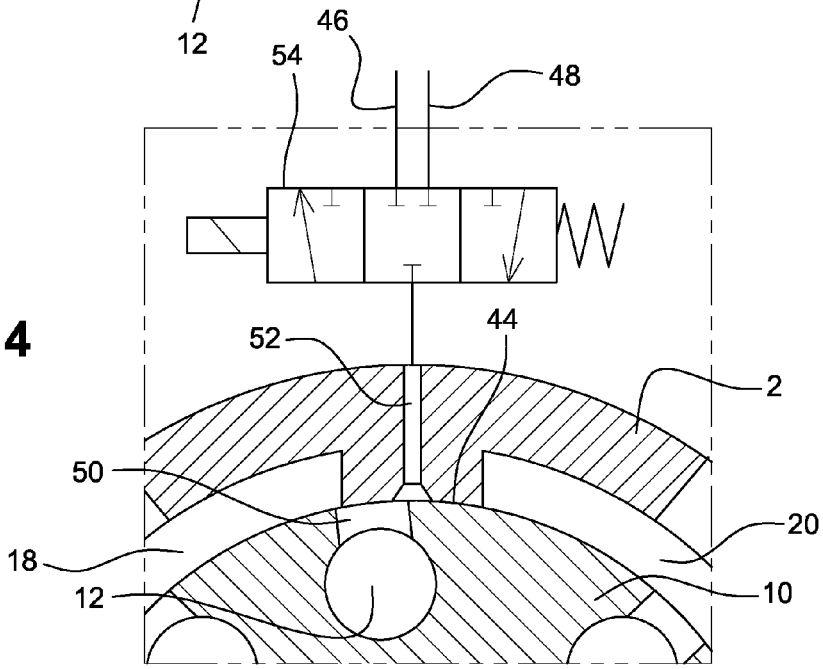
FIG. 4 is a detailed view of FIG. 2 comprising a particular angular position of the cylinder.

In addition, as detailed in FIG. 4, for each hydraulic circuit with large or small displacement, each angular sealing section 44 comprises in its central part a small radial channel 52 connected to a transition solenoid valve 54 which can operate proportionally or as all or nothing, to alternatively leave this central channel closed or to connect it to one of the two external channels 46, 48.

The width of the communication conduits 50, 70 of cylinder 10 is provided so that these conduits exit in a given angular position of this cylinder, at the same time in one of the two pressure chambers 18, 20 and in central channel 52, as shown in FIG. 4.

In particular, for going from the low pressure chamber 18 to the high pressure chamber 20, central channel 52 is connected by transition solenoid valve 54 to the external high pressure channel 48 and for going from the high pressure chamber 20 to the low pressure chamber 18, one connects this central channel to external low pressure channel 46. The flow of the central channel 52 is controlled by its diameter, or by the transition solenoid valve 54 which is proportional.

The transition solenoid valves 54 permit a progressive passage from one pressure chamber to the other, so as to avoid hydraulic compressions or cavitation problems, which produce noise and torque pulsations at low rotation speeds.

One obtains as such a hydraulic machine 1 comprising two independently adjustable or controllable displacements which is embodied very compactly by using a single cylinder 10 mounted on a shaft 6, and situated in one and the same housing 2. In particular, one uses in cylinder 10 a radially available space inside the first series of small diameter pistons 22, which avoids using a second cylinder, and which provides a light, compact and economical unit with a limited number of components.

In addition, with a single rotating cylinder 10, losses are reduced and the performance of hydraulic machine 1 is improved with respect to other types of machine, achieving two different displacements with two cylinders.

As a variant, the hydraulic machine 1 can operate with fewer functions, such as without the supply solenoid valves 56, 76 or without transition solenoid valves 54 which can be replaced by calibrated valves to limit the flow.

The hydraulic machine can also include common high and low pressure chambers with a common rotating distributor for the two hydraulic small and large displacement circuits, which simplifies the embodiment of this machine, but brings reduced performances.

Thanks to its good performance, to its reduced weight and its compactness, which facilitates its incorporation in a vehicle, this hydraulic machine can be used beneficially in a hybrid vehicle.

The invention claimed is:

1. A variable displacement hydraulic machine comprising a rotating cylinder including a first series of axial pistons connected to a first plate axially located on a first side of the cylinder in a transverse plane for which the slope can be controlled or adjusted, to form a first controllable displacement for said machine; the cylinder also including a second series of axial pistons connected to a second plate for which the slope is controllable or adjustable and which is located, with respect to the first plate axially on a second side of the cylinder, to form a second controllable cylinder of this machine; the two series of pistons of each displacement each forming a crown centered on the axis of the cylinder and having a different radius such that one of the series of axial pistons defines an inner crown and the other of the series of axial pistons defines an external crown; the two displacements of this machine each including a same number of pistons; the pistons of the inner crown being angularly offset with respect to the pistons of the external crown, and the two series of pistons being received in respective series of bores, the respective series of bores being offset one with respect to the other in their axial direction by partially overlapping each other; wherein the machine includes for each displacement a hydraulic circuit that includes a low pressure chamber and a high pressure chamber, separated by two angular sections situated at two diametrically opposite locations in contact with an external cylindrical wall of the cylinder; the angular sections forming a dynamic seal between the low pressure and high pressure chambers, with each bore of the pistons including a communication conduit radially arranged toward the outside of the cylinder to communicate with the chambers.

2. The hydraulic machine according to claim 1, wherein the two plates each include an independent control or adjustment of their slope which permits controlling or adjusting the slope of the two plates around their respective traverse planes.

3. The hydraulic machine according to claim 1, wherein the low pressure chambers and high pressure chambers as well as the communication conduits of each hydraulic circuit, are located on the transverse planes axially offset one from the other.

4. The hydraulic machine according to claim 1 wherein each angular seal section includes in its central part, a central channel connected to the outside hydraulic circuit; the width of the communication conduits is provided so that these conduits exit at a certain angular position of the cylinder at the same time in one of the two pressure chambers and in this central channel.

5. The hydraulic machine according to claim 4, wherein a transition solenoid valve is arranged between the central channel and the outside hydraulic circuit.

6. A drive train for a hybrid vehicle, wherein the hybrid vehicle includes the hydraulic traction machine of claim 1.

7. A hybrid vehicle having a drive train including a combustion engine and a hydraulic traction machine wherein the hydraulic traction machine is the hydraulic machine of claim 1.

8. A variable displacement hydraulic machine comprising a rotating cylinder including:

a first series of axial pistons connected to a first rotationally fixed plate axially located on a first side of the cylinder in a transverse plane for which the slope can be controlled or adjusted, to form a first controllable displacement for said machine;

a second series of axial pistons connected to a second rotationally fixed plate for which the slope is controllable or adjustable and which is located, with respect to the first plate axially on a second side of the cylinder, to form a second controllable cylinder of this machine;

wherein, the two series of pistons each form a crown centered on the axis of the cylinder and each have a different radius such that one of the series of axial pistons defines an inner crown and the other of the series of axial pistons defines an external crown; the two series of pistons each including a same number of pistons; the pistons of the inner crown being angularly offset with respect to the pistons of the external crown, and the two series of pistons being received in respective series of bores, the respective series of bores being offset one with respect to the other in their axial direction by partially overlapping each other; and wherein, the pistons of the first series of pistons have a different diameter than a diameter of the pistons of the second series of pistons such that the hydraulic machine has a first displacement defined by the diameter and maximum stroke of the first series of pistons and a second displacement defined by the diameter and maximum stroke of the second series of pistons, with the first displacement being greater than the second displacement.

* * * * *